United States Patent [19]

Reich

[11] 3,968,759

[45] July 13, 1976

[54] AUTOMATIC YARN CHANGER

[76] Inventor: Rudolf Reich, 6, An der Ringstrasse, Neuwied, Germany

[22] Filed: Oct. 15, 1974

[21] Appl. No.: 514,531

[30] Foreign Application Priority Data

Oct. 18, 1973 Germany ..... 2352207

[52] U.S. Cl. ..... 112/83; 112/96

[51] Int. Cl.[2] ..... D05C 3/04

[58] Field of Search ..... 112/78, 83, 96, 97

[56] References Cited

UNITED STATES PATENTS

| | | | |
|---|---|---|---|
| 876,562 | 1/1908 | Kleutgen | 112/83 X |
| 1,148,557 | 8/1915 | Weber | 112/96 |
| 3,009,433 | 11/1961 | Kuhn | 112/97 X |

FOREIGN PATENTS OR APPLICATIONS

| | | | |
|---|---|---|---|
| 302,050 | 10/1932 | Italy | 112/83 |

*Primary Examiner*—Alfred R. Guest
*Attorney, Agent, or Firm*—Michael P. Breston

[57] ABSTRACT

In necessary embroidery machine, especially in an area embroidery machine the combination of a yarn support stand together with feed yarn rolls for all needle yarns required for the operation of the machine which are arranged in a yarn group, a yarn storage and tensioning device for accommodating the needle yarns over the feed yarn rolls with the same yarn lengths and for tension free and continuous supply of the yarn ncessary for the operation of the machine while the embroidering mechanism is running, and a clamping arrangement, by means of which the stationary feed yarn rolls in the yarn support stand can be clamped and changed.

11 Claims, 12 Drawing Figures

Fig.4
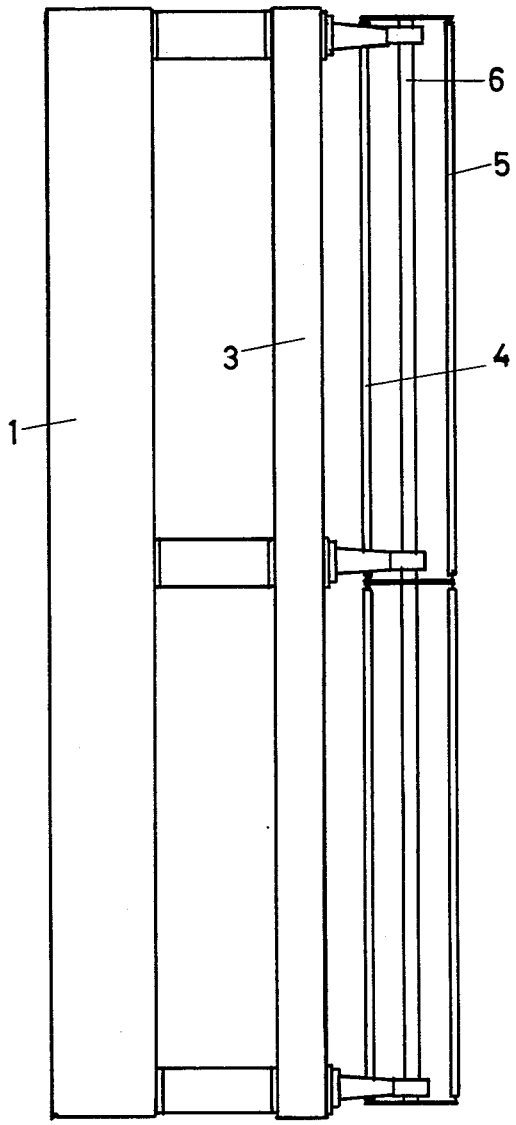
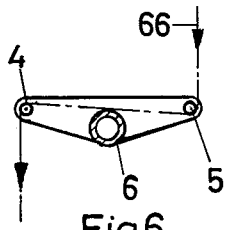
Fig6
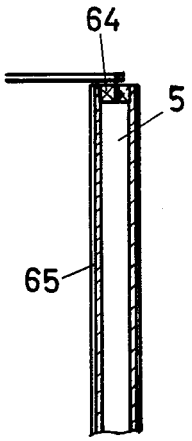
Fig.5

98
97
94
93
96
95
15'
100
92
91
99
9'
6'
7'
3'
81
86
85
87
89
88
84
82
83
1
80
102
105
104
103
106

AUTOMATIC YARN CHANGER

BACKGROUND OF THE INVENTION

This invention refers to an arrangement for embroidery machines, or similar machines, especially for area embroidery machines, in which the yarn ends which have to be fed in on the needle side must be changed when the yarn feeding system has run empty or, in the case of change of the embroidery pattern, when all or only some of the embroidery stations must be changed.

In shuttle type embroidery machines double T spools with relatively small amounts of yarn are used because the space available on the machine is not adequate for larger spools. Moreover, larger spools are associated with problems of maintaining the constancy of the yarn tension for the embroidery machinery (progressively decreasing weight and diameter). The feeding movement of the spools promotes the associated loop and knot formation and it is not possible to avoid the sudden jumping off of whole layers of yarn due to the jerky yarn take up of the embroidery mechanism.

Owing to the low yarn volumes of individual spools, conventional embroidery machines need a great deal of personnel expenditure and time for the change of needle yarns and this is associated with frequent standstill of the machines. The standstill can last up to 7 hours in any single instance for machines with 1,000 embroidery stations and will require employment of a large number of persons and this can occur on average, several times per week. Since the embroidery technique requires permanent change of patterns, and variations of the appearance of the product are absolutely necessary by changing the needle yarns, this operation, therefore, in conjunction with the required standstill of the machines, forms quite an appreciable cost factor.

It is seen from the above that, owing to the restricted space on the embroidery machine, a large number of spools of yarn is required and hence only a very small amount of yarn can be made up for use on the machine. The result of this arrangment is that in the first place small quantities of yarn have to be made up in a previous intermediate working process, which once again leads to increased costs. Moreover, the yarn sets which are lifted from the embroidery machines will, if used again, inherently lead to damage of individual spools of yarn resulting in new sources of embroidery defects which become effective later.

SUMMARY OF THE INVENTION

A main object of this invention, which is based on the above problems is to produce an arrangement by means of which an embroidery machine can be fed with yarn during the production process automatically and without any interruption of the production process in which especially the stopping of the machine for the purpose of yarn change is eliminated. A further object of this invention is to carry out the arrangement of the feed yarn as economically as possible. For this reason the number of spools of yarn is kept as small as possible. The needle yarns are accommodated all together into an enclosed arrangement and this arrangement is to be replaced on the embroidery machine only if and when required.

According to a further object of this invention the embroidery machine is to be maintained in fully operational condition during the yarn change and at a standstill of the machine.

According to this invention, a replaceable yarn support stand carries large size feed yarn rolls for all needle yarns which are arranged into a yarn group and which are required for the operation of the machine. A moveable yarn storage and tensioning arrangement accommodates the needle yarns from the feed yarn rolls with the same lengths of yarn and for tension free and continuous supply of the yarn necessary for the operation of the machine, while the embroidery mechanism is running, whereby the yarn capacity of said yarn storage and tensioning arrangement is sufficiently large in order to provide yarn required during the change of the yarn rolls or by the yarn support stand. A clamping device is provided by means of which the resting feed yarn rolls in the yarn support stand can be clamped and changed.

The yarn support stand accommodates feed yarn rolls of any size and it is designed to be replaceable and preferably mobile. A yarn clamp is provided on the yarn support stand or independently from the yarn support stand. This clamp becomes effective on replacing a yarn. This yarn clamp is arranged between the yarn support stand and the yarn storage and tensioning arrangement. The storage and tensioning arrangement acts as a compensating means between the standstill situation when changing yarn and the operating embroidery mechanism so that the embroidery mechanism is not at all influenced by the yarn change. The yarn storage capacity in this case must be at least so great that it is sufficient for the changing of the feed yarn rolls or of the yarn support stand and that it provides the necessary knotting length of individual yarns to the new feed yarn rolls. In a preferred version the yarn storage and tensioning arrangement can travel so that it can be used on different embroidery machines.

This yarn storage and tensioning arrangement, for example, comprises a combination of fixed, rotating rollers as well as a lifting and lowering arrangement for the roller combination which can be lowered. Whereas during normal operation the rows of rollers, which are guided through the yarn storage and tensioning arrangement by the yarn support stand, will assume their normal position on normal operation, the row of rollers, which are capable of being lowered, will be moved downwards, e.g. by a motor drive, yarn loops will be formed and the quantity of yarn required for this purpose will be drawn from the feed yarn rolls. A climbing lift, a spindle drive, or a similar device is used for moving the vertically travelling row of rollers upwards and downwards. The yarn storage and tensioning arrangement itself, however, can be formed in some other suitable manner in the form of a yarn intermediate store.

For the purpose of extending the yarn loops in the case of working with the yarn storage and tensioning arrangement the belt brakes are actuated and the store roller combination will be moved into the horizontal yarn plane; with the special embodiment of this invention this is carried out by arranging the stationary rollers below the yarn group plane; the moving rolls are arranged above the yarn group plane. The storage and tensioning arrangement is filled by lowering the storage rollers which can be moved downwards. The stored yarn group is locked by the clamping roller; the yarn is subsequently disconnected, the feed yarn rollers are replaced and the clamped yarns are knotted to the yarns of the new feed yarn spools. The embroidery machine is fed during this period from the storage and tensioning arrangement with the feed yarn.

The yarn tensioning rocker, which is rotatably attached to the machine, is rotated by the moving yarn and this results in using up the yarn loop. The yarn tensioning rocker is associated with a sensing control system, e.g. in the form of electronic switches which are called initiators and which generate a pulse when approaching a metallic component. Driving the yarn storage and tensioning arrangement is controlled by said pulse. This ensures that the feed yarn is free from tangles and it is released with approximately constant yarn tension.

The clamping roll is removed from its operation range and brake weights are applied after the feed yarn spools have been positioned. It is possible to supply the required feed yarn to the embroidery machine over the newly loaded feed yarn rolls, after the yarn loops are used up in the yarn storage and tensioning arrangement, without further manual intervention.

In this case the yarn storage and tensioning arrangement is made inoperative and, in the case of a travelling or transportable yarn storage and tensioning arrangement, this arrangement can be used on a different embroidery machine for replacement of feed yarn.

ADVANTAGES OF THE INVENTION

Considerable advantages are gained with this invention in comparison with the previously known arrangements;

Lower manufacturing costs are achieved, owing to the possibility of using larger spools of yarn. The number of the spools will also be significantly smaller (in the case of a practical embodiment the number of the spools will be reduced to one tenth of the previous number).

In comparison with previous methods in which all embroidery machines had to be completely stopped for yarn replacement, the output is significantly increased by the arrangement according to the invention because it is not necessary to stop the machine.

Fewer yarn and needle breakages will take place, on using the arrangement according to the invention, because the tensions are eliminated from the yarn package by means of the yarn whip. The expenditure due to correction of the embroidery is reduced because fewer embroidery pattern faults will occur due to the reduced number of the yarn and needle breakages. These correction times at present form about 10 to 20 % of the final price of the embroidery product, as it is more advantageous to keep the embroidery machine running with faults in the product rather than to stop the machine.

The needle yarn is fed tightly from the storage position of the yarn roll stand support to the emery roller or the single yarn brake. This eliminates any kind of tangle or loop formation or similar distortion of the embroidery yarns which are markedly twisted, so that the above arrangement eliminates the danger of machine standstill and also defects in finished products due to this fault source. A constant change of conditions of the tensioned and loosely stretched needle yarns is caused by the intermediate racking arrangement of the embroidery frame on the embroidery process. The combination of the yarn contact rocker and of the yarn tensioning whip picks up the part of the yarn which becomes loose and tensions it, so that the yarn twisting effects are eliminated. The embroidery products have a more uniform appearance, when using the tension free continuous needle yarn feeding system, than those achieved previously.

Since the yarn support stand must rest on the machine floor only at the point of time of the yarn replacement, in a machine according to the invention, the space which becomes free due to the movable arrangement can be made available for other purposes. A conditioning process is proposed for large spools of yarn in order to achieve lower costs.

The necessary condition for automation of the operation on positioning of the yarn is the simultaneous yarn feed from the feed yarn rolls to all embroidery embroidery stations.

BRIEF DESCRIPTION OF THE DRAWINGS

FIG. 4 shows a plan view of the yarn tensioning rocker in the horizontal position, FIG. 5 shows a section through the rotating deflector of the yarn tensioning rocker, FIG. 6 shows a cross section through the yarn tensioning rocker.

DESCRIPTION OF THE PREFERRED EMBODIMENT

Figure 1:
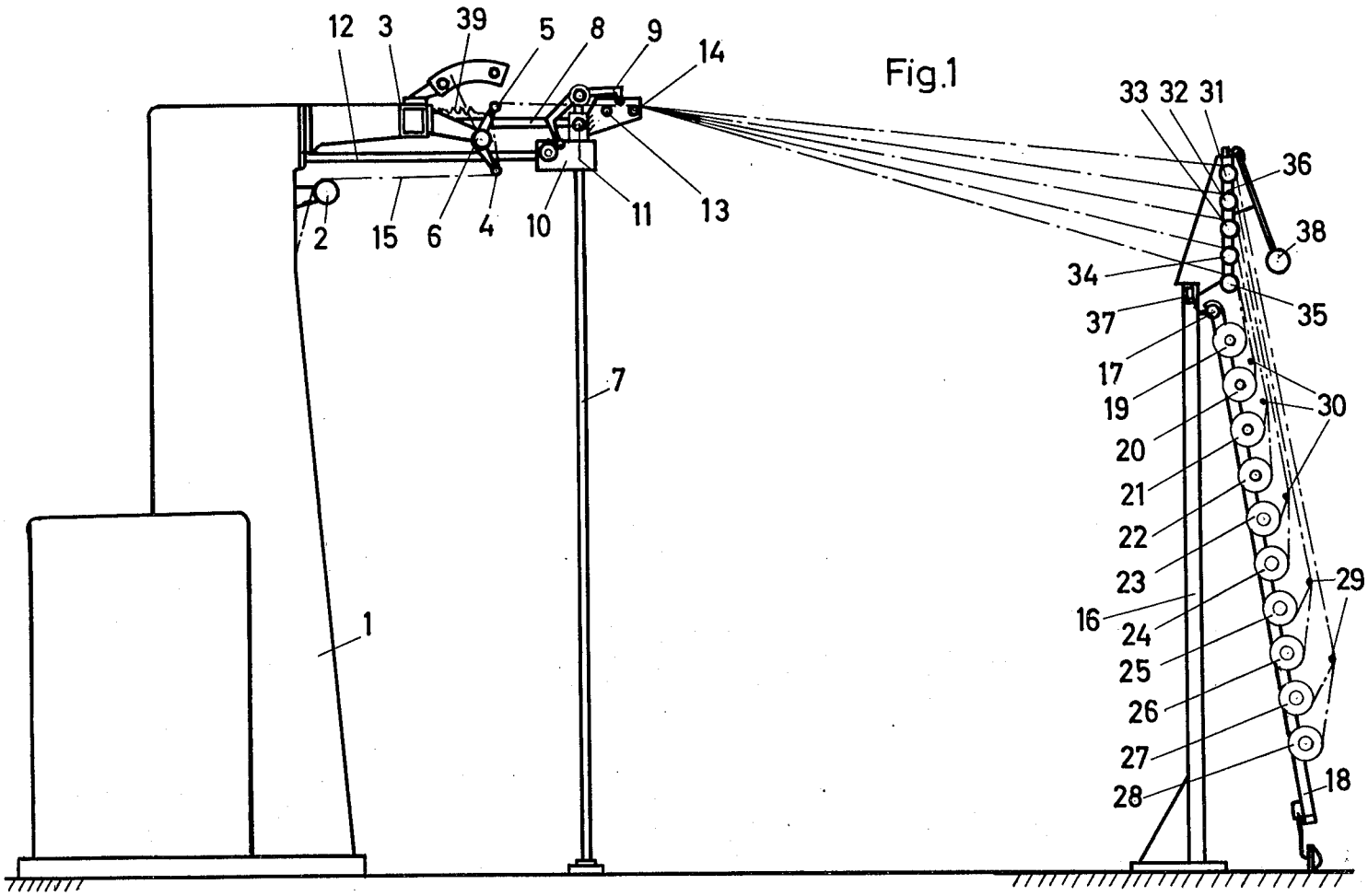
FIG. 1 shows the arrangement according to the invention, which is an overall view during operation.

FIG. 1 shows the overall arrangement together with the embroidery machine 1, associated emery roller 2, transverse beam 3, deflector tube 4, 5 for the yarn tensioning rocker and the central tube 6. The support pillar 7, in conjunction with the transverse member 8 carries the swinging yarn whip 9 as well as its drive unit 10. The arrangement is reinforced by the tube 11, while the torque from the running embroidery machine is transmitted to the drive unit 10 via the rotating shaft 12. The round profiles 13 and 14 are associated with the yarn tensioning whip 9 and they support the yarn group 15.

The stationary support pillar 16 accommodates the movable, replaceable spool frame 18 by means of the transverse profile 17. This spool frame 18 is provided with, for example, 10 rotating feed yarn rolls 19 to 28. These feed rolls 19 to 28 are associated with pairs of reversing elements 29, 30 which are connected with the spool frame 18 by means of bearing means (not shown). Each of the feed yarn rolls 19 to 28 can accomodate for example 50 individual filaments, e.g. the yarn rolls for the yarn group 15. The reversing elements 31, 32, 33, 34, 35 are rotatably supported by element 36, which is fastened on the transverse member 37.

FIG. 1 shows schematically a diagram of a swingable clamping roller 38, which can be brought into contact with the reversing elements 34 and 35. This clamp can be used for clamping all filaments, as described below.

In normal operation of the embroidery machine 1 the yarn tensioning whip 9, which is moved upwards and downwards by means of the drive unit 10 through the rotating shaft 12 in such a manner that yarn loops can be formed between the round profiles 13 and 14. Assuming that the rotatable deflector tubes 4 and 5 of the yarn tensioning whip with their swingable central tube 6 can be rotated only in the direction of the yarn feed, and that said tubes 4 and 5 have a friction layer or similar means then it is possible to apply so much yarn retardation on the yarn group 15 that the whip 9 is in a position to pull yarn from the rotating feed yarn rolls 19 to 28 due to its upwards and downwards movement, without operating upon the emery roller 2 or the individual yarn brakes with yarn tension peaks in a detrimental manner. This procedure ensures that the emery cloth roller 2 or the individual yarn brakes according to their function vary the yarn tension from the embroidering field via the needle according to the stitch size. Moreover, the spring 39 in FIG. 1 acts as a damping means for the yarn tensions.

Figure 2:
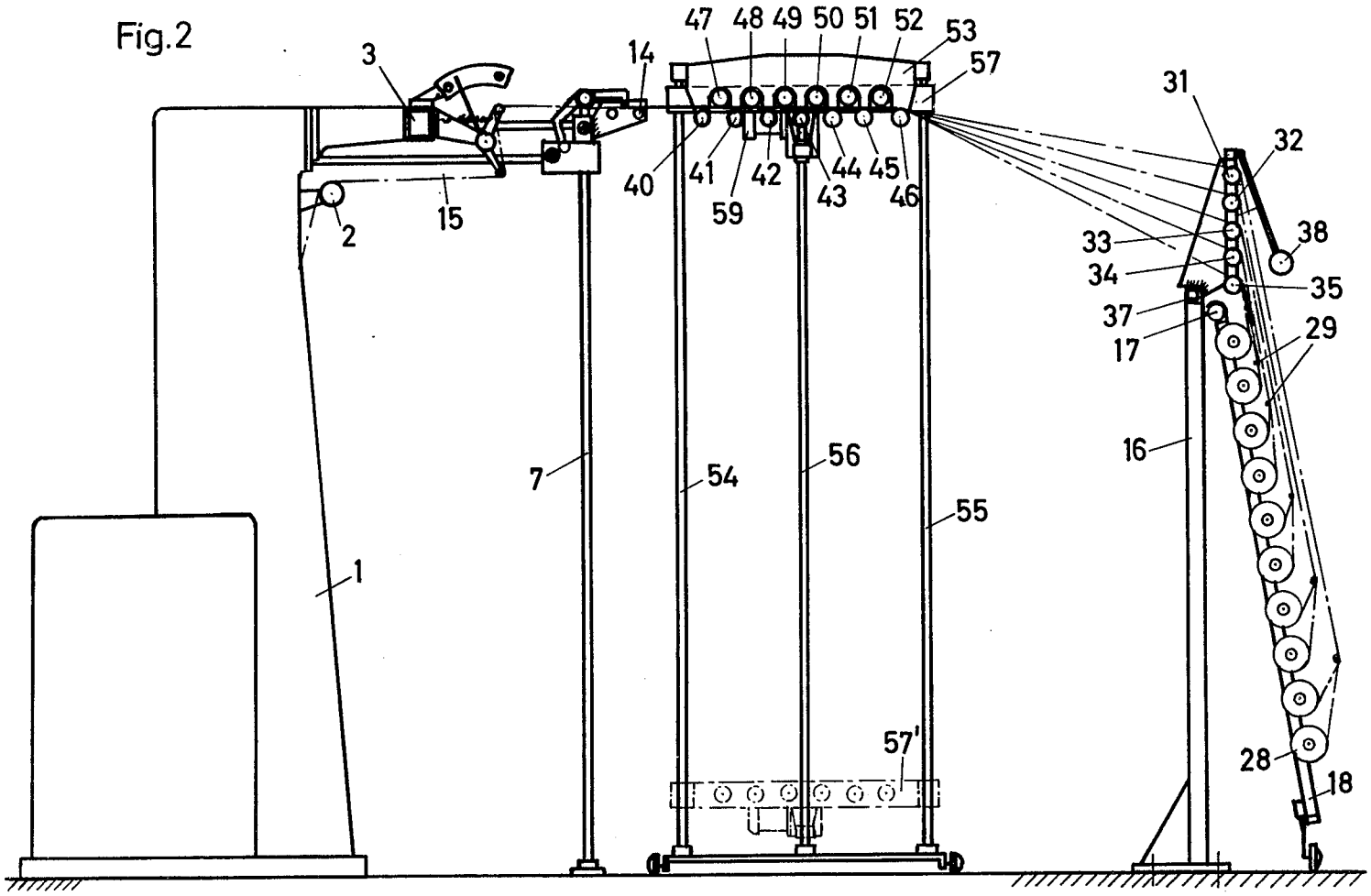
FIG. 2 shows the arrangement according to the invention, which is an overall view with movable yarn storage and tensioning arrangement.
Figure 3:
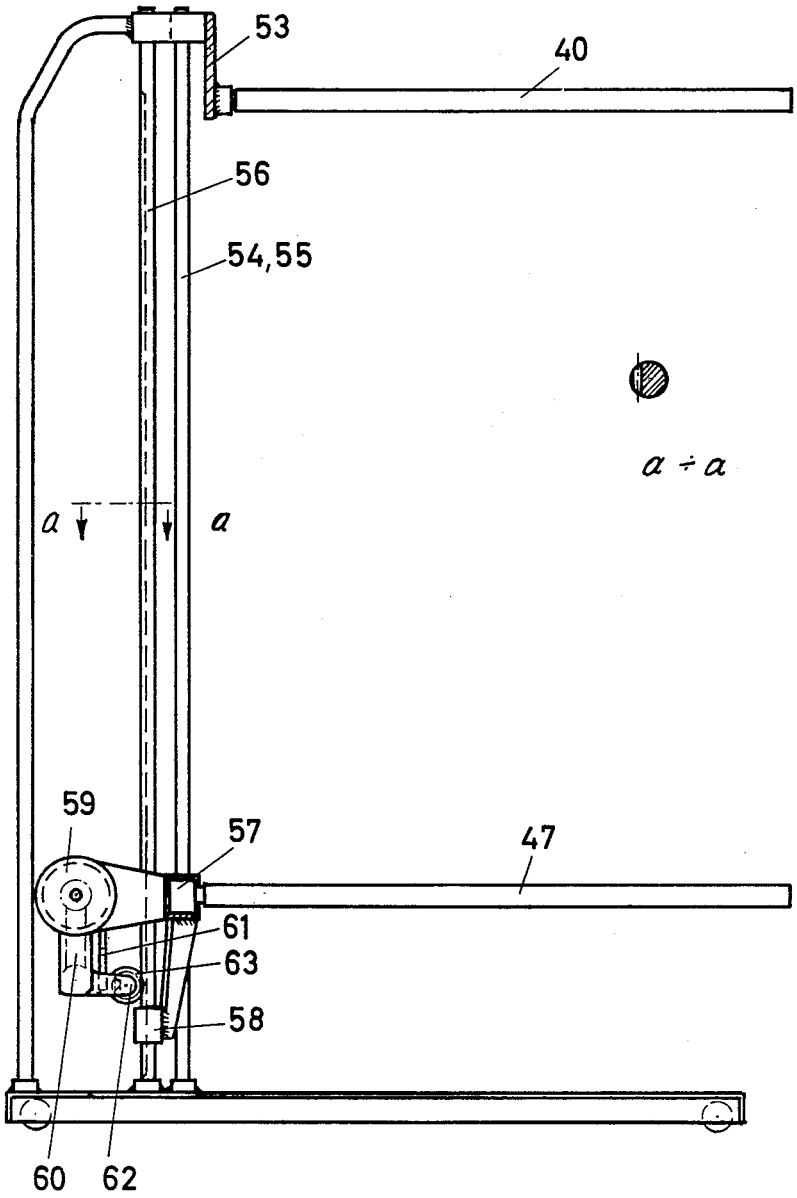
FIG. 3 shows a side view of the movable yarn storage and tensioning arrangement.

FIG. 2 shows the travelling yarn storage and tensioning arrangement according to FIG. 3 which, in this diagram, is pushed between the round profile 14 of the yarn whip 9 and the fixed, rotating deflecting members, 31, 32, 33, 34, 35. As shown in FIG. 2 the yarn of the yarn group 15 passes over the stationary rotating rolls 40, 41, 42, 43, 44, 45, 46. The combination of the rolls 47, 48, 49, 50, 51, 52 can be lowered in relation to the rollers 40 to 46. The fixed rolls 40 to 46 are mounted on a head piece 53 (FIGS. 2 and 3) as an overhung arrangement. The head piece 53 connects the parallel pillars 54 and 55. The staggered central pillar 56, according to FIGS. 2 and 3, is formed as a toothed rack according to the section *a — a* of FIG. 3. The transverse beam 57 is connected by means of ball joints to the pillars 54, 55 and to the central column 56 so that it can be moved, whereby the central bearing, in the bearing mounting 58 according to FIG. 3, is arranged lower in order to avoid stick slip effects and in order to support the load. The motor 59, according to FIG. 3, drives a worm gear drive 60, which drives the spur gear 63 at its end via the toothed belt 61 and the angular drive 62 (shown in dotted lines). A climbing lift is formed by the toothed rack cutout in the central column 56. Instead of this climbing lift other conventional arrangements can also be used such as, for example, spindle drive and similar arrangements. The transverse beam 57 can be lowered, together with the roller combination 47, 48, 49, 50, 51, 52 (FIG. 2), so that the beam will assume position 57' (FIG. 2, shown in dotted lines).

If the rolls 40–46 (FIG. 2) have been moved to their lowermost position between the lower rolls 40–46 and the stationary upper rolls 47–52, sufficient withdrawn yarn is available for continuously embroidering from rolls 19–28 (FIG. 1) within the storage and tensioning arrangement that the stored amount of yarn will be sufficient to press roll 38 at a single spot against the entire yarn group, so that all threads of the yarn rolls 19–28 can be cut through, the rolls can be replaced by new ones, and the yarns can be connected to the machine yarn, which is the former yarn. Therefore, roll 38 is urged a short time — only if the storage and tensioning arrangement is filled and if the yarn rolls are changed — against the rotating deflecting members 34, 35 and into the space between members 34, 35 so that the yarn will not tangle.

The filling of the yarn storage and tensioning arrangement is carried out in the following manner: if the motor 59 is switched on by means of a switch not shown, then the transverse beam 57 is lowered, together with the roller combination 47 to 52, into the lowermost position according to FIG. 2. In this case the rotating rollers 47 to 52 pass through the yarn group 15 in the region of the fixed, rotating rollers 40 to 46, (FIG. 2) and they pull out yarn loops by pulling out the required yarn from the feed yarn rolls 19 to 28.

FIG. 4 shows the yarn tensioning rocker on the embroidery machine 1 as well as its mounting on the transverse beam 3. The part sectional view of the deflector tube 5 (FIG. 5) shows the ratchet arrangement 64 and the weaving beam cover 65 pulled on the tube 5 in order to increase the retarding capacity exlained above. The ratchet arrangement 64 (FIG. 5) will ensure that yarn is transported only in the direction of the arrow 66 in FIG. 6.

Figure 7:
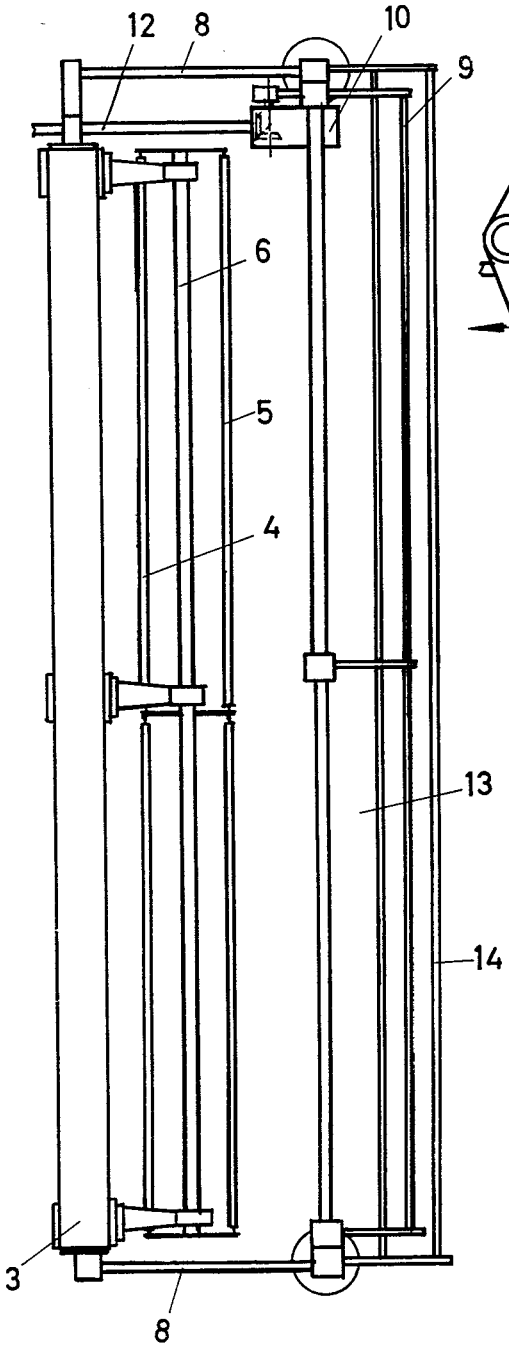
FIG. 7 shows a plan view of the yarn tensioning rocker together with the yarn whip.

FIG. 7 shows the plan view of the yarn tensioning rocker 4, 5, 6, that of the yarn tensioning whip 9, together with the drive unit 10, and the rotating shaft 12 together with the transverse member 3, which is a component of the embroidery machine 1.

Figure 8:
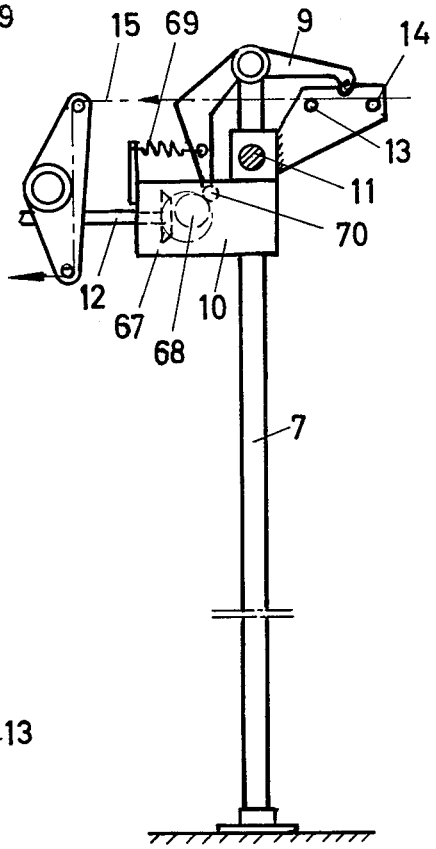
FIG. 8 shows a side view of the yarn whip with drive.

FIG. 8 shows an example of the drive of the yarn tensioning whip 9. According to this the drive unit 10 is moved by means of the rotating shaft 12 by the embroidery machine which is not shown in FIG. 7. The rotating movement is transmitted via the pair of bevel gears 67 on to the disc cam 68. The spring 69 presses the follower roller 70, which is connected to the yarn tensioning whip 9, against the edge of the disc cam which generates the required upwards and downward movement of the yarn tensioning whip 9.

Figure 10:
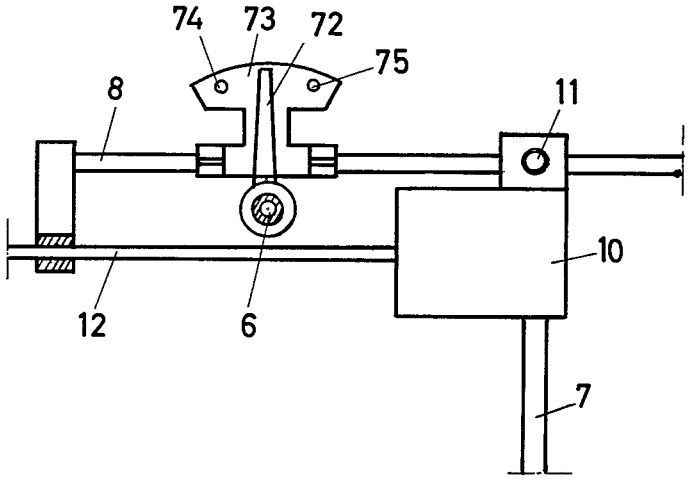
FIG. 10 shows a side view of the initiator unit with switching lug.
Figure 9:
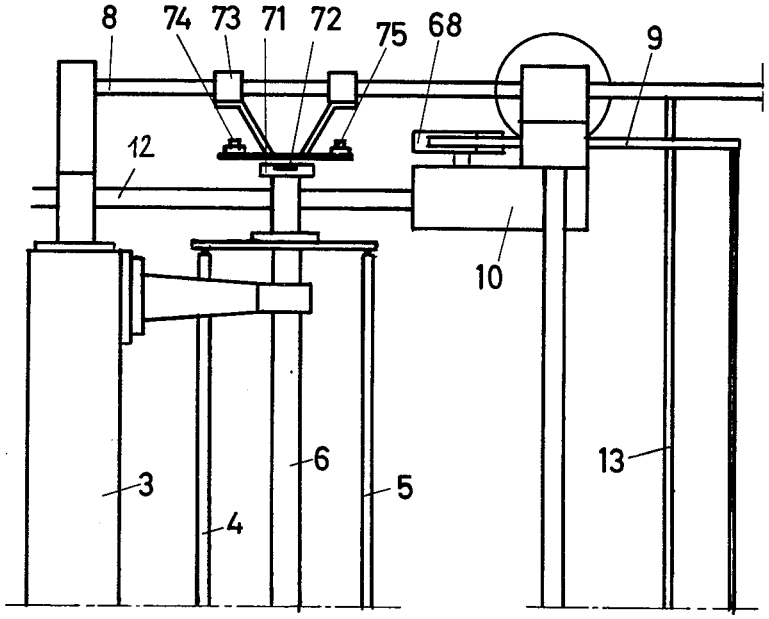
FIG. 9 shows a plan view of the initiator unit.

FIG. 9 shows the detachable or statinary control unit as a typical example. The tubular component 71 is mounted on the yarn tensioning arm 4, 5, 6. The switching lug 72 (FIG. 10) is firmly connected with the tubular component 71. The beam 73 (FIGS. 9 and 10) accomodates the initiators 74 and 75 and, as shown in FIG. 10, it can be mounted on the transverse element 8. The climbing lift, which consists of motor 59, worm wheel drive 60 together with toothed belt 61, annular drive 62 and the spur gear 63 (FIG. 3), will be moved upwards or downwards, depending on the deflection of the yarn tensioning rocker, at that instant when the switching lug 72 (FIG. 10) passes the initiator 74 or 75. The pulse amplification system which is not shown is associated with the traveling yarn storage and tensioning arrangement according to FIG. 3 and it can be used for loading of a number of embroidery machines.

All the individual yarns of the yarn group 15 are disconnected by applying the clamping roller 38 (FIG. 2) to the deflecting elements 34 and 35, after the yarn storage and tensioning arrangement has been filled. If the operating embroidery machine 1 now requires more yarn, then, according to FIG. 2 and FIG. 10, the central tube 6 of the yarn tensioning rocker is rotated. The switching lug 72 (FIG. 10) will be moved, during the course of the continuing embroidery process, into the vicinity of the initiator 75.

The control system, which is not shown, is for example, designed in such a manner that the transverse beam 57 (FIG. 2), together with its combination of rolls 47 to 52 is moved upwards from its position 57 which is shown on the diagram with dotted lines. The yarn tensioning rocker 4, 5, 6 is immediately moved out of its position, in which case the yarns are pulled out against the force of the spring 75 (FIG. 2). If the switching lug is situated over the initiator 74 (FIG. 10) then the climbing lift is switched on stop and it will carry out downwards movement with delay provided by a time relay. This delay should prevent a hunting effect.

In a further embodiment of the invention the production area will be best utilised for the modern shuttle embroidery-quilting machine. The arrangement according to FIG. 1, together with the stationary pillar 16 for accommodating the feed yarn rolls 19 to 28 by means of the feed yarn support stand 18 is designed as a mobile unit so that this space becomes available as the transport lane for the material flow and similar activities. The transport lane is occupied only for a short time on loading of the production machine with new feed yarns.

Moreover, according to the invention, the hydraulic system which is already provided in the machine can be used for lifting of the feed yarn support stand (platform). This can be carried out preferably fully automatically during the embroidery process. In this case use is made of the position of the already described yarn tensioning rocker with the central tube 6 (FIG. 1) so that a pulse is transmitted via the initiators 74 and 75 (FIGS. 9 and 10) to a solenoid-operated multiway slide valve. The valve acts upon a following piston, so that the complete feed yarn platform can be moved in proportion to the feed yarn tension which prevails in the yarn group 15. In this case the yarn storage and tensioning arrangement according to FIG. 3 can also be used.

Figures 11, 12:
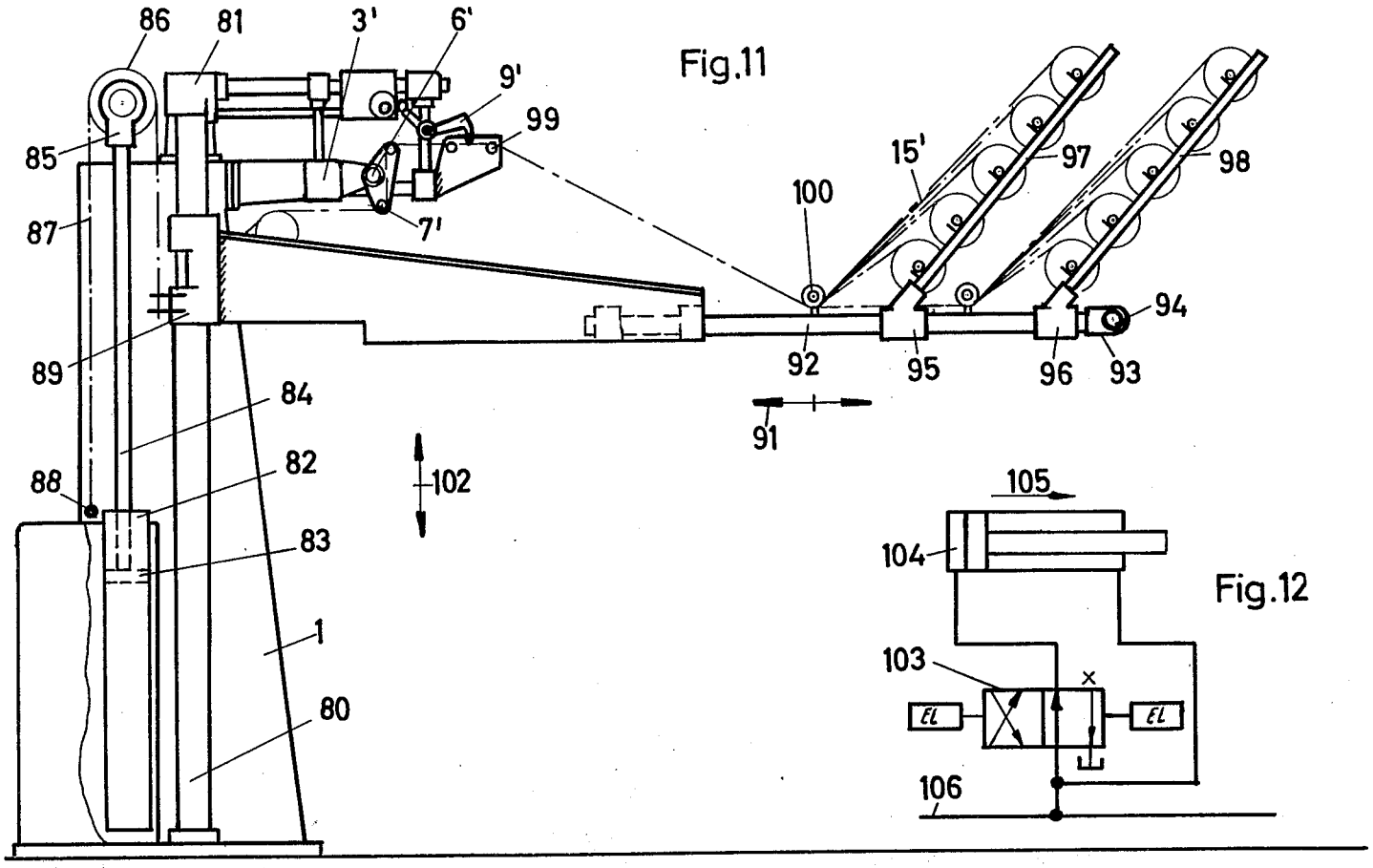
FIG. 11 shows a side view of the feed yarn lifting platform.
FIG. 12 shows a diagram of a hydraulic slider.

FIGS. 11 and 12 show details of a further embodiment of the invention. The shuttle embroidery machine 1 together with the transverse members 3 and the yarn tensioning rocker 5, 6 is provided with stationary pillars 80 on both sides outside the machine stand. Pillar 80 is fixed by means of the stand 81. A long stroke cylinder 82 is fitted into the main drive. This accommodates the piston 83 and the piston rod 84. The latter comprises a piece 85 with a diagrammatically shown chain sprocket wheel 86. The cantilever 90 made from light alloy is anchored by means of the bearing element 89. The arm 92 can be moved (pulled out) in the direction of the arrow 91. It has a is provided with piece 93, together with a component 94 which is shown on the diagram with dotted lines and which is a connecting element to the opposite side of the machine. Both branch pieces 95 and 96 allow the mounting of the feed yarn stand 97 and 98.

This double arrangement can also be accommodated within a stand, in which the space requirements are of decisive importance. The yarn tensioning whip 9 allows the withdrawal of the yarn group 15 without any reaction on the emery roller 2. The length of the yarn between the rotating deflecting element 99 and the deflection roller 100 is selected in such a manner that the yarn storage and tensioning arrangement, according to FIG. 3, can be accommodated without any difficulty. The clamping roller 38, according to FIG. 1 (not shown in FIG. 11) will be fitted according to its functions. The travelling yarn storage and tensioning arrangement according to FIG. 3 will be brought in before the downwards movement of the feed yarn lifting platform and it is operated in a specified manner. Member 94 connects the elements of the opposite machine side to form a complete feed yarn lifting platform.

The complete feed yarn lifting platform can be lowered from the indicated position by means of the long stroke cylinder 82 in the direction of the arrow 102. This increases the yarn length between the rotating deflecting spring 99 and the deflecting roller 100. The electromagnetic hydraulic slider 103 (FIG. 12) is actuated, in proportion to the displacement of the yarn tensioning arm 5, 6, in order to bring the already described feed yarn lifting platform into the uppermost position with loop free feed yarns for example after clearing a process fault in the feed yarn rollers 19 to 28. The diagrammatically shown following cylinder 104 would move into the indicated switching position in the direction of the arrow 105. The hydraulic slide valve 103 is connected to the installed main pipeline 106 of the shuttle embroidery machine 1. The initiators not shown correspond to the previously described elements 74, 75 of FIG. 10 and, by means of a suitable switch and in the same manner, in relation to the yarn tensions and according to the need, they control the climbing lift of the storage and tensioning device (FIG. 3).

I claim:

1. An arrangement for an embroidery machine having a needle side and in which the yarn ends to be fed at said needle side are to be changed, comprising:

a replaceable yarn support stand;

a plurality of feed yarn rolls for the needle yarns required by the operations of said machine, said yarns being arranged in a close yarn group;

a movable yarn storage and tensioning arrangement separate from the embroidery machine adapted to withdraw an amount of yarn from said feed yarn rolls required for changing the yarn, and to accommodate the needle yarns from the feed yarn rolls with the same yarn lengths and for tension free and continuous supply of the yarn necessary for the operation while the embroidery mechanism is running; and a yarn clamping device provided between said yarn support stand and said storage and tensioning arrangement, said clamping device clamping the resting feed yarn rolls in the yarn support stand for changing the yarn rolls.

2. The arrangement according to claim 1, wherein said yarn support stand is a mobile unit.

3. The arrangement according to claim 1, wherein said yarn storage and tensioning arrangement is a mobile unit.

4. An arrangement according to claim 3, wherein said rolls are provided as flying arrangements.

5. The arrangement according to claim 1, and further including a deflecting tube, a yarn tensioning whip, and a sensor-controlled system, and said system supplying yarn to the machine's running embroidery mechanism in a tension-free and continuous manner.

6. The arrangement according to claim 5, wherein said sensor controlled system includes initiator switches.

7. An arrangement according to claim 5, wherein said deflecting tube has a free-wheel and a weaving beam cover in order to increase the yarn retarding capability.

8. An arrangement according to claim 1, wherein said yarn storage and tensioning arrangement includes a lower row of stationary rollers and an upper row of rollers which is movable relative to the lower row of rollers at right angles thereto, a drive for the movable rollers, and wherein a yarn group is passed between the two rows of rollers and is taken up by them so that between the upper and the lower rows of rollers is formed the yarn amount necessary for the storage thereof.

9. An arrangement according to claim 8, wherein said rollers are provided as flying arrangements.

10. An arrangement according to claim 1, wherein the height of the entering yarn group is adjustable by said feed yarn support stand.

11. An arrangement according to claim 1, wherein said rolls are provided as flying arrangements.

* * * * *